US008720234B2

(12) United States Patent
Kim et al.

(10) Patent No.: US 8,720,234 B2
(45) Date of Patent: May 13, 2014

(54) LAUNDRY TREATING APPARATUS

(75) Inventors: Jin Woong Kim, Seoul (KR); Jae Won Chang, Seoul (KR); Dong Won Kim, Seoul (KR); Bo Sung Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 549 days.

(21) Appl. No.: 12/879,746

(22) Filed: Sep. 10, 2010

(65) Prior Publication Data

US 2011/0062839 A1 Mar. 17, 2011

(30) Foreign Application Priority Data

Sep. 14, 2009 (KR) ..... 10-2009-0086532
Sep. 15, 2009 (KR) ..... 10-2009-0087143
Sep. 29, 2009 (KR) ..... 10-2009-0092579

(51) Int. Cl.
*B08B 3/00* (2006.01)

(52) U.S. Cl.
USPC ..... 68/3 R

(58) Field of Classification Search
USPC ..... 68/3 R
See application file for complete search history.

(56) References Cited

U.S. PATENT DOCUMENTS

2004/0083769 A1* 5/2004 Kim et al. ..... 68/12.02

FOREIGN PATENT DOCUMENTS

| | | | |
|---|---|---|---|
| JP | 2003-164690 | | 6/2003 |
| KR | 10-2005-0111042 | A | 11/2005 |
| KR | 10-2007-0038720 | A | 4/2007 |
| KR | 10-2007-0070779 | A | 7/2007 |
| KR | 10-0888655 | B1 | 3/2009 |
| KR | 10-2009-0079793 | A | 7/2009 |

* cited by examiner

*Primary Examiner* — Jason Ko
(74) *Attorney, Agent, or Firm* — McKenna Long & Aldridge LLP

(57) ABSTRACT

The laundry treating apparatus includes a cabinet forming an external appearance of the laundry treating apparatus, the cabinet having a laundry entrance opening for introducing laundry therethrough, a door rotatably coupled to the cabinet for opening and closing the laundry entrance opening, a hook provided at the door, and a door switch provided at the cabinet such that the hook can be latched to the door switch to prevent the door from being opened. The door switch separates the hook for opening the door.

4 Claims, 22 Drawing Sheets

LAUNDRY TREATING APPARATUS

The present application claims priority to Korean Application No. 10-2009-0086532 filed in Korea on Sep. 14, 2009, Korean Application No. 10-2009-0087143 filed in Korea on Sep. 15, 2009, Korean Application No. 10-2009-0092579 filed in Korea on Sep. 29, 2009, the entire contents of which are hereby incorporated by reference in their entirety.

BACKGROUND

1. Field of the Disclosure

The present disclosure relates to a laundry treating apparatus, and, more particularly, to a laundry treating apparatus capable of having a door that automatically opens.

2. Discussion of the Related Art

Generally, a laundry treating apparatus is a common designation for various kinds of treating apparatus that treat laundry by applying physical and chemical actions to the laundry, such as a washing machine that removes contaminants from clothes, bedding, etc. (hereinafter, referred to as 'laundry') using a chemical decomposition action of water and detergent, and a physical action, such as friction, between water and laundry; a drying machine that dries wet laundry by spinning; and a refresher that sprays heated steam to the laundry for preventing the occurrence of allergic reaction due to the laundry and, in addition, for easily and conveniently washing the laundry.

In such a laundry treating apparatus, however, a laundry entrance opening is kept closed by a door when the laundry treating apparatus is not in use, with the result that germs and mold are easily propagated due to damp air and the airtight environment of the laundry treating apparatus. Consequently, an inherent goal of the laundry treating apparatus, to maintain cleanliness and hygiene of clothes, is not satisfied.

SUMMARY

It is an object of the disclosure to disclose a laundry treating apparatus having an automatic opening type door.

It is another object of the disclosure to disclose a laundry treating apparatus wherein locking, lock releasing, and automatic opening of a door are easily achieved.

Accordingly, the above and other objects can be accomplished by the provision of a laundry treating apparatus including a cabinet forming an external appearance of the laundry treating apparatus, the cabinet having a laundry entrance opening for introducing laundry therethrough, a door rotatably coupled to the cabinet for opening and closing the laundry entrance opening, a hook provided at the door for closing the door, and a door switch provided at the cabinet such that the hook can be latched to the door switch, wherein the door switch separates the hook for opening the door.

DETAILED DESCRIPTION OF THE PREFERRED EMBODIMENTS

Figure 1:
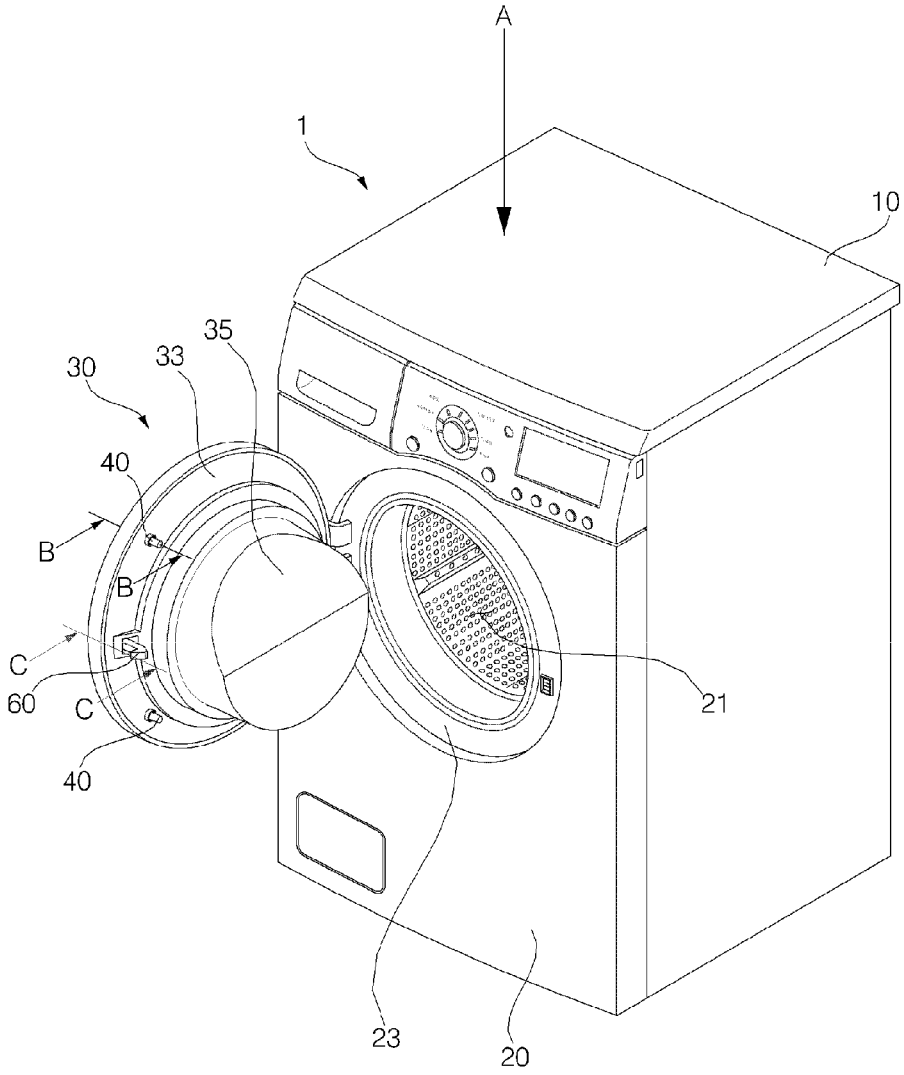
FIG. 1 is a perspective view showing a laundry treating apparatus according to an embodiment of the present invention.

The advantages and features of the laundry treating apparatus, and the way of attaining them, will become apparent with reference to embodiments described below in conjunction with the accompanying drawings. However, the present invention is not limited to the embodiments disclosed below and will be embodied in a variety of different forms; rather, these embodiments are provided so that this disclosure will be thorough and complete. Like reference numerals refer to like elements throughout the specification.

Now, exemplary embodiments of a laundry treating apparatus according to the present invention will hereinafter be described in detail with reference to the accompanying drawings.

Figure 2:
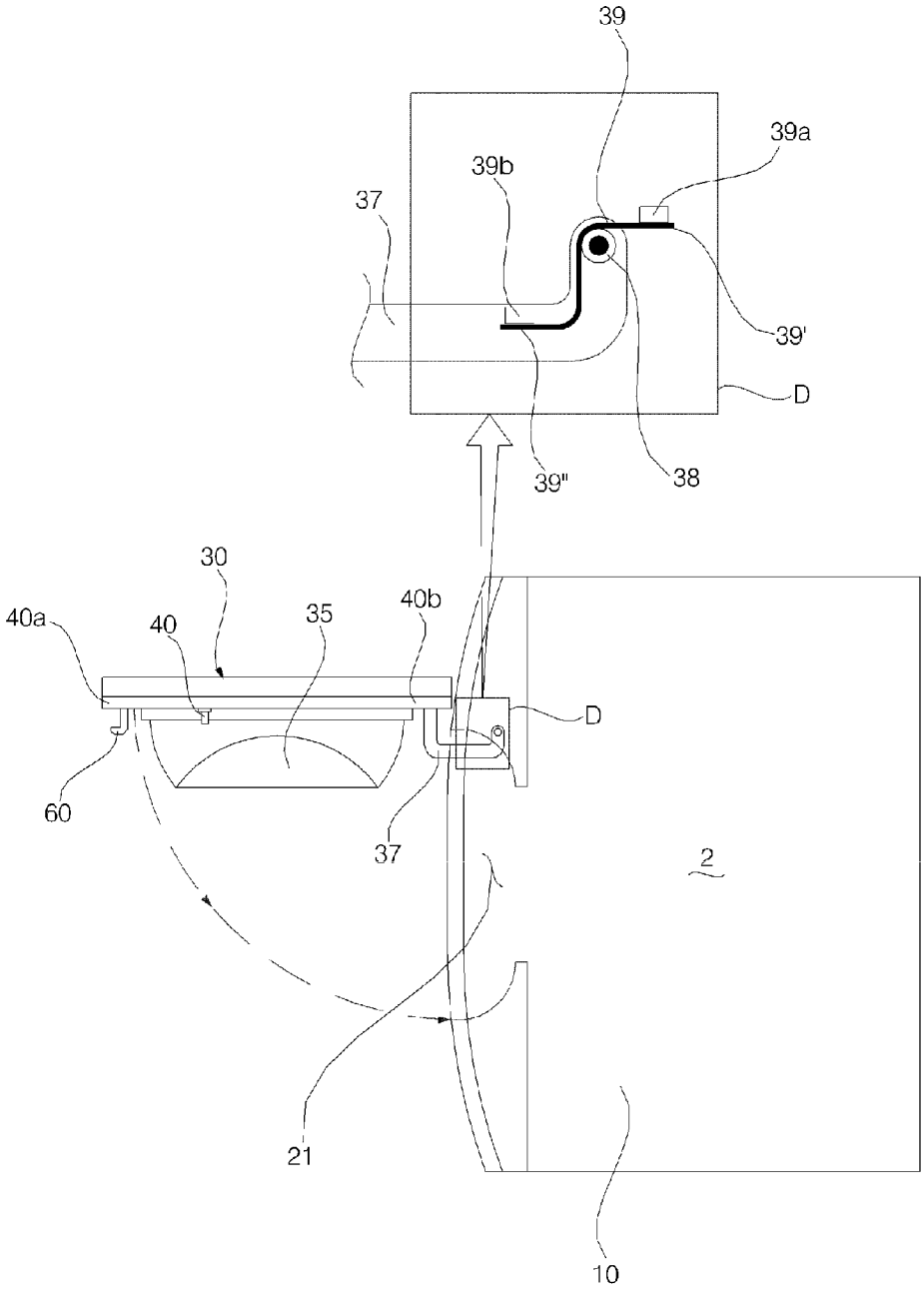
FIG. 2 is a plan view of FIG. 1 as seen in a direction indicated by an arrow A.

FIG. 1 is a perspective view showing a laundry treating apparatus according to an embodiment of the present invention, and FIG. 2 is a plan view of FIG. 1 as seen in a direction indicated by an arrow A.

In this embodiment, a laundry treating apparatus 1 includes a cabinet 10 for accommodating laundry therein, the cabinet 10 having a laundry entrance opening 21 for introducing the laundry therethrough, and a door 30 rotatably mounted to the front of the cabinet 10 for opening and closing the laundry entrance opening 21.

The cabinet 10 forms an external appearance of the laundry treating apparatus 1. A door receiving part 23 for receiving the door 30 is formed at the cabinet 10 around the laundry entrance opening 21.

The door 30 includes a transparent part 35 formed in the shape of a circle and made of a transparent material and a door frame 33 forming the circumference of the transparent part 35.

The door 30 has one end 40*b* rotatably coupled to the door receiving part 23 of the cabinet 10 via a door hinge 38. The door 30 moves toward the laundry entrance opening 21, while rotating about the door hinge 38, and is located at the door receiving part 23 to close the laundry entrance opening 21.

The door hinge 38 is provided with a door elastic member 39 having one end 39' supported by a first support part 39*a* formed in the cabinet 10 and the other end 39" supported by a second support part 39*b* formed at a hinge rod 37 connected to the door 30. The door elastic member 39 provides elastic force in a direction in which the door 30 opens away from the laundry entrance opening 21. The door elastic member 39 may be in a form of a torsion spring provided at the door hinge 38.

A hook 60 is disposed at the other end 40*a* of the door 30. The hook 60 is latched to a door switch 100 (see, for example, FIG. 5) provided at the door receiving part 23 for latching the door 30 to prevent the door 30 from being opened and to prevent wash water from leaking outside during washing. The hook 60 is rotatably coupled to the door 30 such that the hook 60 can be latched to or latch released from the door switch 100.

When the door 30 is closed, the hook 60 is latched to the door switch 100. When the treatment of laundry is completed, the door switch 100 releases the hook 60 to open the door 30. Details thereof will be described in detail later.

Figure 3:
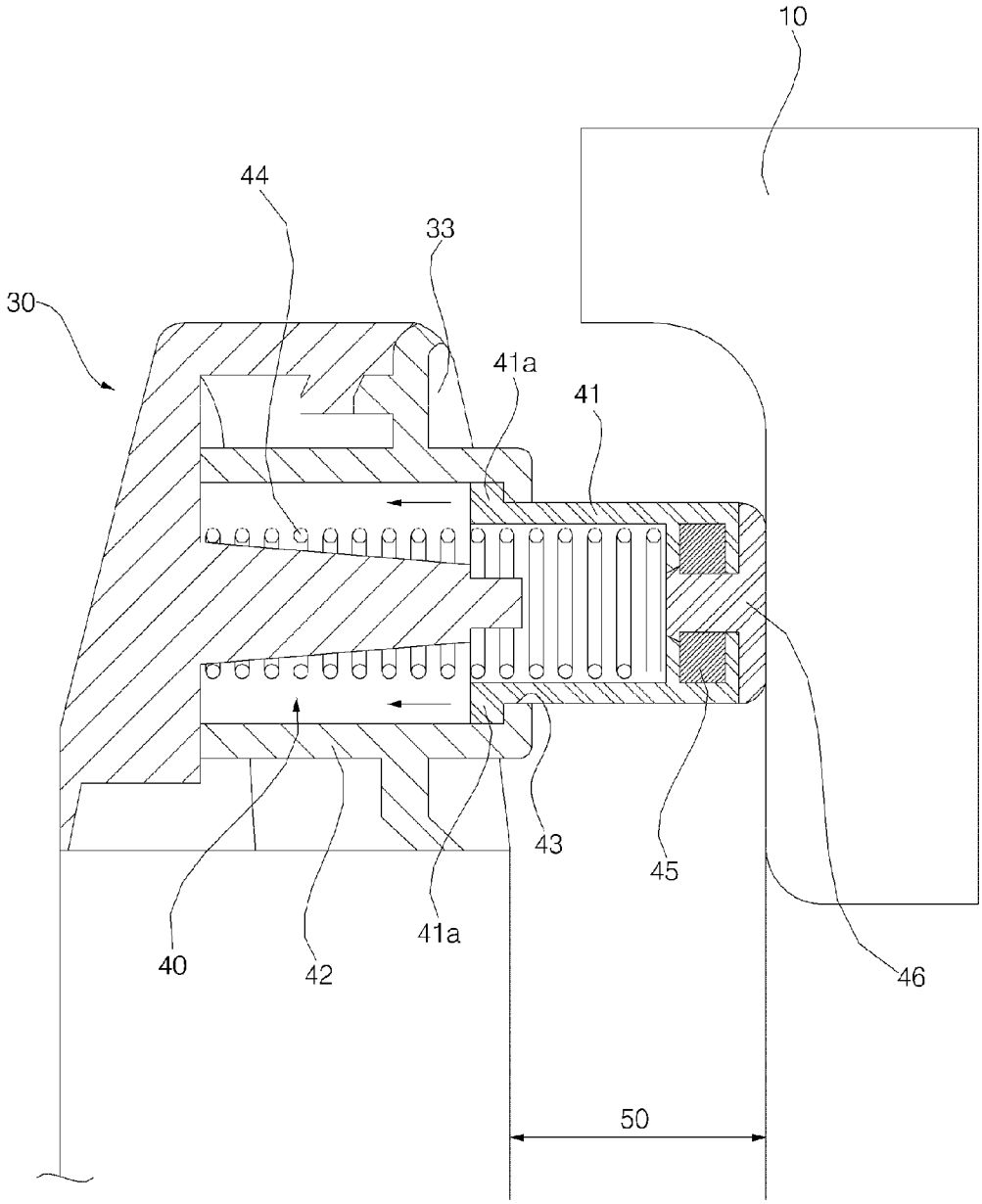
FIG. 3 is a sectional view of a door taken along line B-B of FIG. 1.

FIG. 3 is a sectional view of the door taken along line B-B of FIG. 1. Referring to FIG. 3, the laundry treating apparatus 1 according to this embodiment further includes a support unit 40 mounted in the door 30 that contacts the cabinet 10 when the door 30 is opened and maintains a predetermined separation gap 50 between the door 30 and the cabinet 10.

In this embodiment, the support unit 40 is provided in the door 30. However, this should not be construed as a limitation. For example, the support unit 40 may be provided in the cabinet 10.

The support unit 40 achieves communication between the interior and exterior of a drum (not shown) rotatably disposed in the cabinet 10 through the separation gap 50 between the door 30 and the door receiving part 23.

The support unit 40 includes a support body 41 disposed so as to move inwardly or outwardly of the door 30 and a mount frame 42 having an insertion hole 43 formed inside the door 30 such that the support body 41 is inserted into and protrudes from the insertion hole 43.

When the hook 60 is released from the door switch 100, and, as a result, the door 30 opens from the door receiving part 23, the support body 41 contacts the cabinet 10 to maintain the separation gap 60 between the cabinet 10 and the door 30.

When the door 30 opens, the support body 41 contacts the cabinet 10, for example, before the hook 60 is completely released from the door switch 100 so as to maintain the separation gap 50 between the cabinet 10 and the door 30.

The mount frame 42 may be formed at the door frame 33 as one body. The support body 41 is inserted into the insertion hole 43 of the mount frame 42. A separation preventing protrusion 41*a* for preventing the separation of the support body 41 from the insertion hole 43 may be formed at the support body 41 as one body. The depth of the insertion hole 43 may be greater than at least the length of the support body 41.

The support body 41 is elastically supported with respect to the cabinet 10 by a support elastic member 44. When the hook 60 is released from the door switch 100, the support elastic member 44 applies elastic force to the support body 41 to maintain the separation gap 50 between the door 30 and the cabinet 10 in cooperation with the door elastic member 39.

The support unit 40 may further include a magnet 45 mounted at the tip end of the support body 41 for magnetically coupling the support body 41 with the cabinet 10. The magnet 45 is made of a material having magnetic properties. The door receiving part 23 of the cabinet 10, to which the support body 41 comes into contact at the magnet 45, is preferably made of a material exhibiting high magnetic coupling with the magnet 45, e.g., metal.

The support unit 40 further includes a contact part at the tip end of the support body 41 that may prevent noise from being generated during contact between the support body 41 and the cabinet 10.

The contact part 46 is coupled to the tip end of the support body 41 to prevent noise from being generated when the magnet 45 or the tip end of the support body 41 comes into direct contact with the door receiving part 23 of the cabinet 10, made of metal. The contact part 46 may be made of silicone or rubber so as to minimize noise generated during contact.

Figure 4:
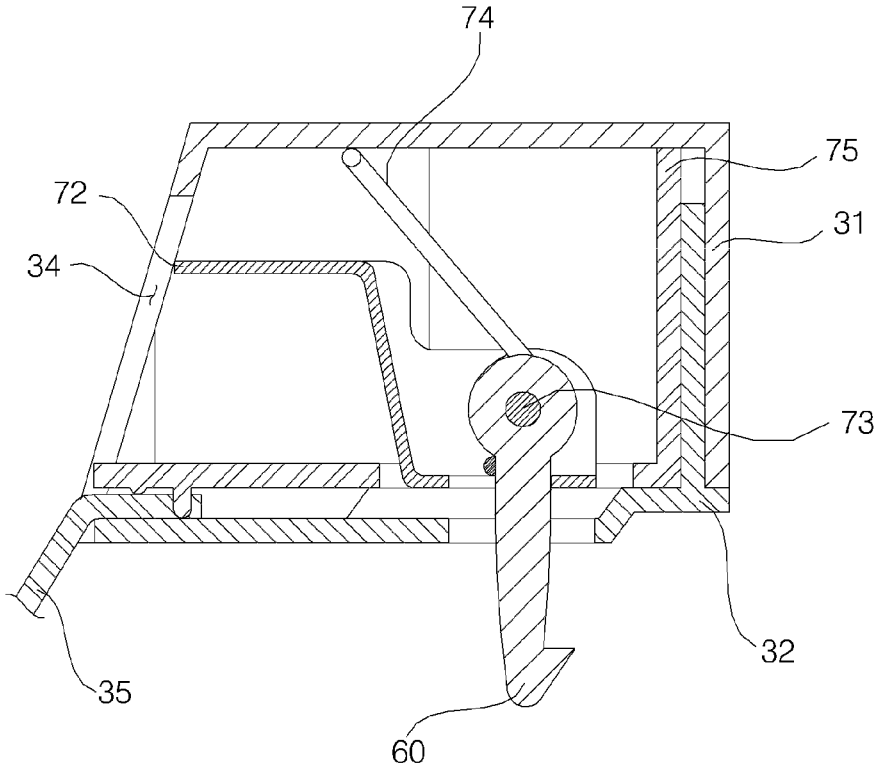
FIG. 4 is a sectional view of the door taken along line C-C of FIG. 1.

Referring to FIG. 4, the door 30 may be provided with a door handle 72. A user may manipulate the door handle 72 to open the door 30. The door handle 72 is rotatably provided inside the door 30. The door handle 72 is operatively connected to the hook 60 such that the hook is rotated simultaneously with the rotation of the door handle 72.

A handle casing 75 may be provided such that the door handle 72 is mounted in the handle casing 75. The door handle 72 is provided in the handle casing 75 such that the door handle 72 is rotated about a handle hinge 73. The hook 60 may be coupled to the handle hinge 73. Also, the hook 60 may be operatively connected to the door handle 72 such that the hook 60 is rotated simultaneously when the door handle 72 is rotated.

When a user grips the door handle 72 through an opening 34 of the handle casing 75 from the front of the door 30 when the door 30 is closed, the door handle 72 and the hook 60 are rotated together, with the result that the coupling between the hook 60 and the door switch 100 is released, whereby the door 30 can be opened.

When the coupling between the hook 60 and the door switch 100 is released, the door 30 is rotated in a direction in which the door 30 is opened that releases forces of the door elastic member 38 provided at the door hinge 38 and the support elastic member 44.

Meanwhile, a handle elastic member 74 may be provided between the door handle 72 and the handle casing 75 such that the hook 60 returns to the original position thereof when the user releases the door handle 72.

Figure 5:
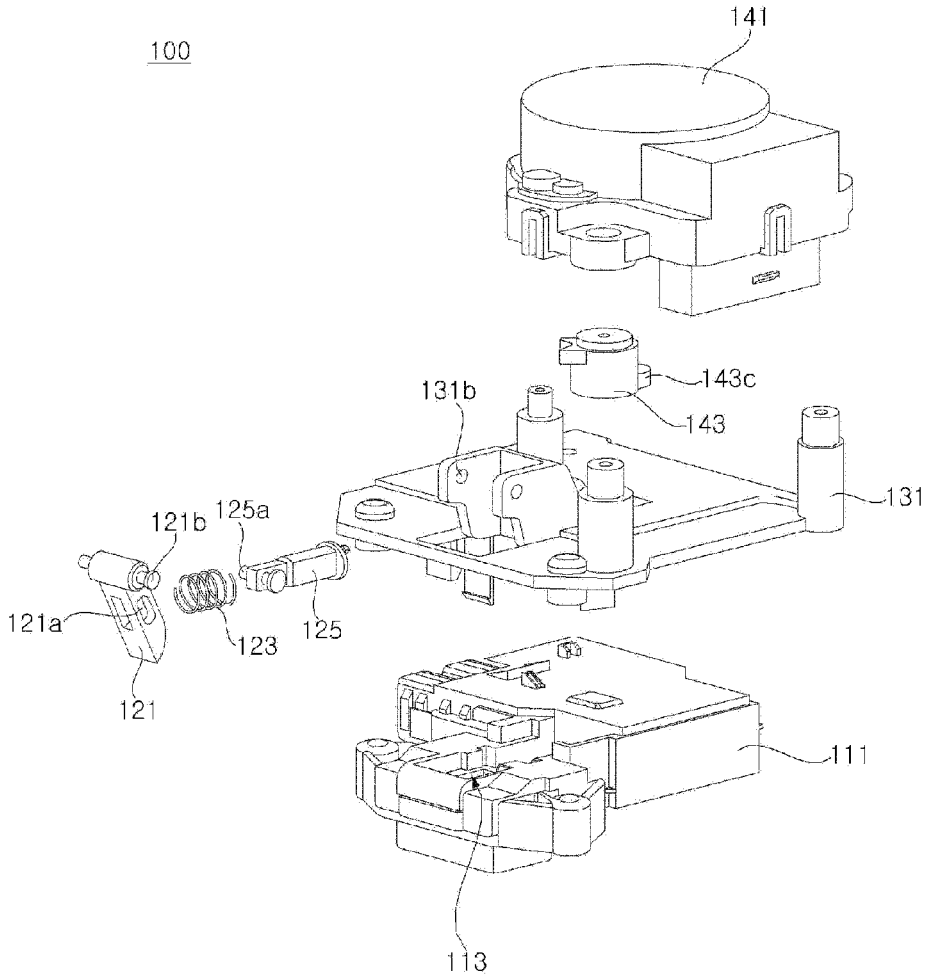
FIG. 5 is an exploded perspective view showing a door switch of a laundry treating apparatus according to an embodiment of the present invention.
Figure 6:
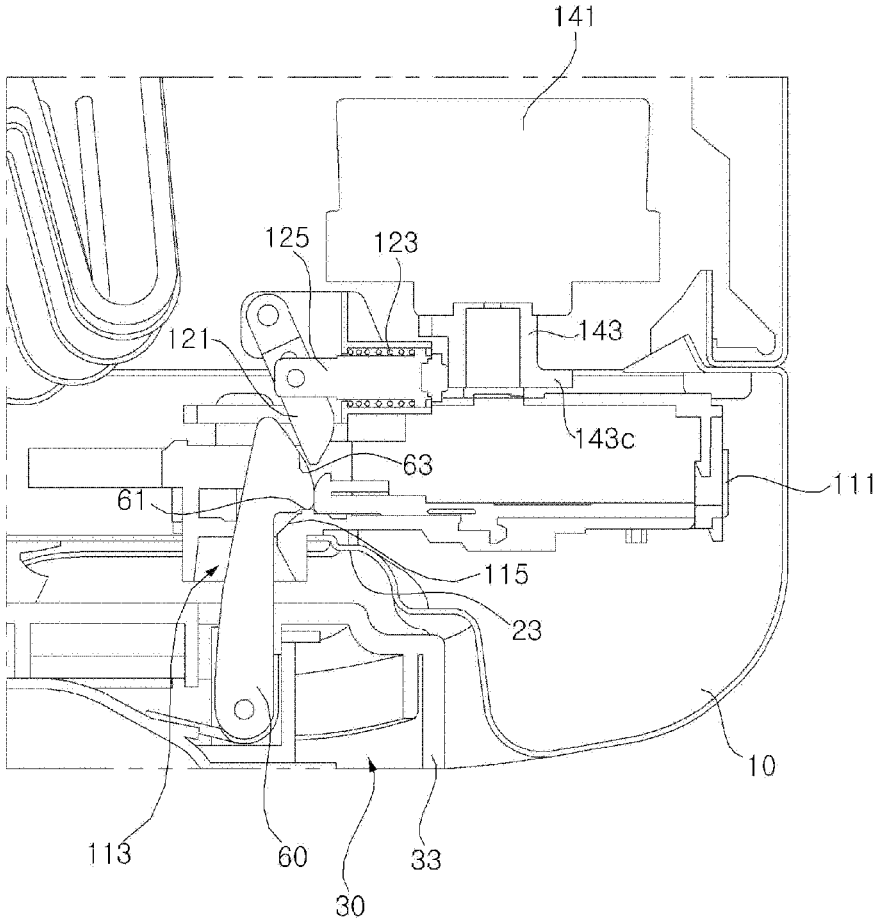
FIG. 6 is a view showing a hook latched to the door switch of FIG. 5.
Figure 7:
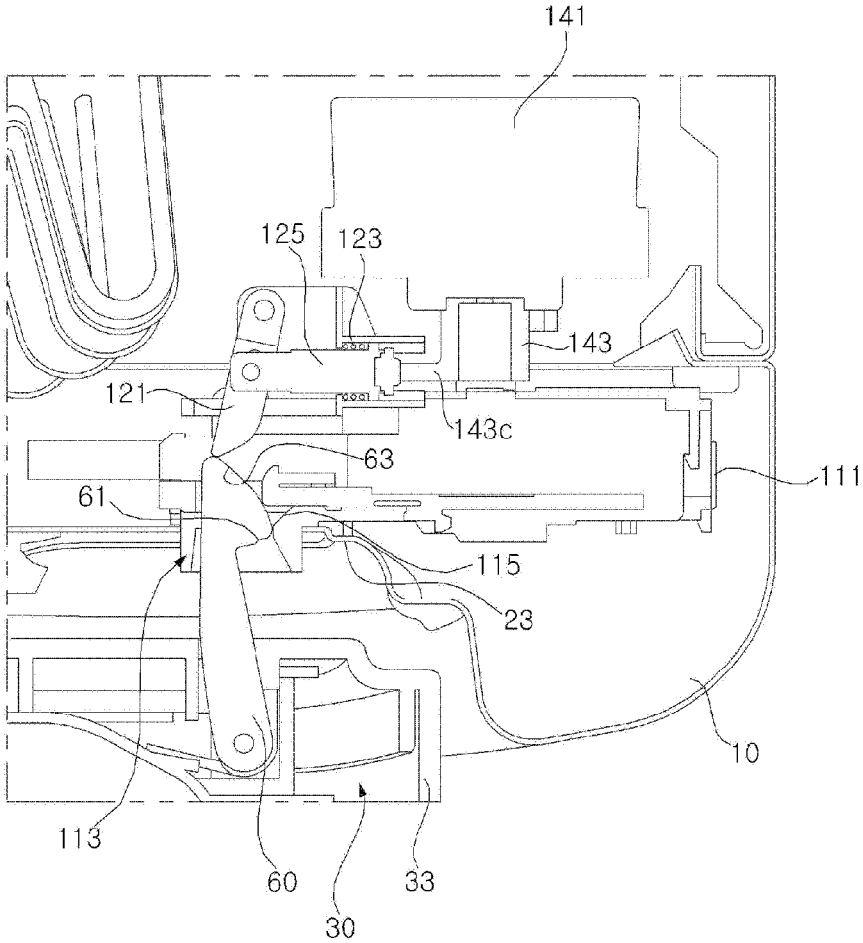
FIG. 7 is a view showing the door switch of FIG. 5 releasing the hook.
Figure 8:
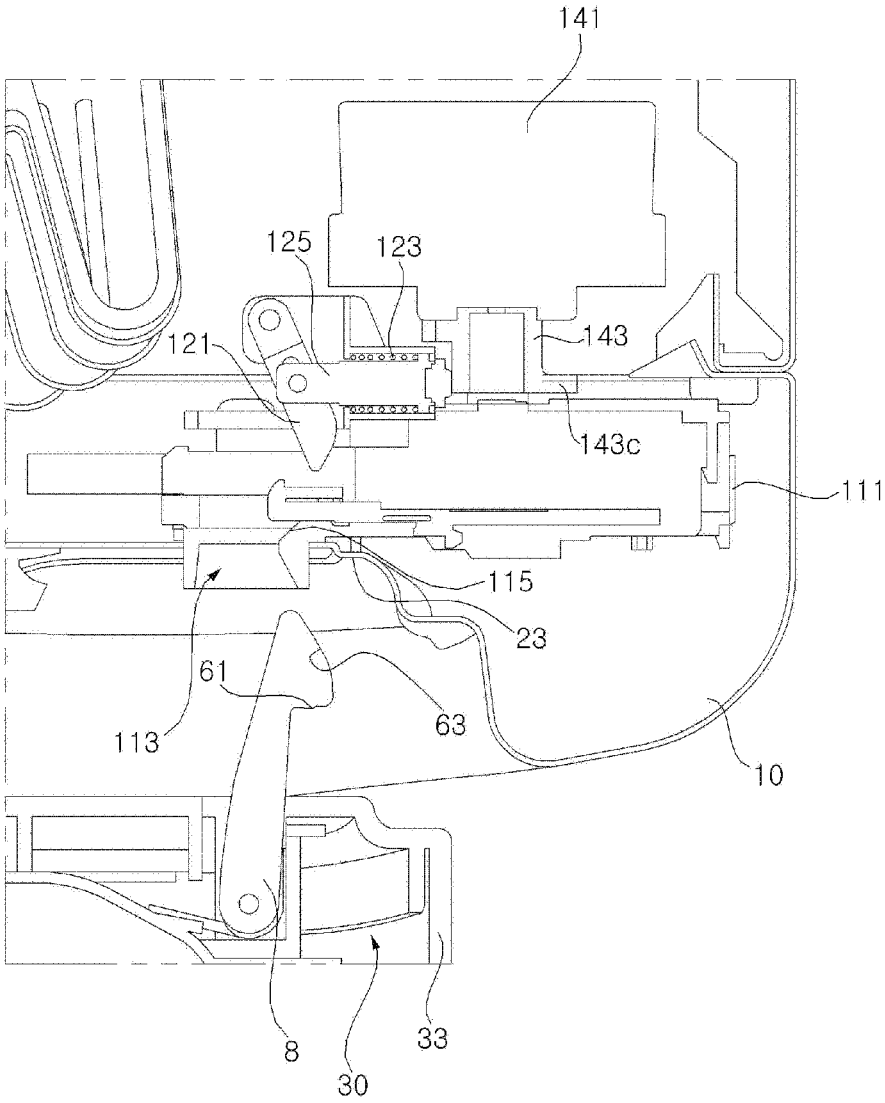
FIG. 8 is a view showing a door being opened as a result of the separation of the hook from the door switch of FIG. 5.

FIG. 5 is an exploded perspective view showing a door switch of a laundry treating apparatus according to an embodiment of the present invention, FIG. 6 is a view showing a hook latched to the door switch of FIG. 5, FIG. 7 is a view showing the door switch of FIG. 5 releasing the hook, and FIG. 8 is a view showing a door being opened as a result of the separation of the hook from the door switch of FIG. 5.

In this embodiment, the door switch 100 includes a lower switch body 111 to which the hook 60 is latched, an upper switch body 131 coupled to the lower switch body 111, a motor 141 for generating rotational force, a cam 143 configured to be rotated by the motor 141, a follower 125 configured to contact the cam 143 for performing a rectilinear motion, and a lever 121 driven by the follower 125 for releasing the hook 60.

The lower switch body 111 is provided with a hook hole 113, into which the hook 60 is inserted. The lower switch body 111 is provided with a switch latch part 115, to which a hook latch part 61 of the hook 60 is latched when the door 30 is closed. The hook latch part 61 latches to the switch latch part 115 when the door 30 is closed.

The motor 141, the cam 143, the follower 125, and the lever 121 are provided at the upper switch body 131. The upper switch body 131 and the lower switch body 111 constitute a switch body.

The motor 141 generates rotational force to rotate the cam 143. The motor 141 is preferably provided at the upper switch body 131. The motor 141 is preferably a synchronous motor suitable for driving the cam 143.

The cam 143 is rotated by the motor 141. A cam protrusion 143*c* is formed at the cam 143. When the door 30 is closed, the cam protrusion 143*c* is positioned in the direction opposite to the follower 125, as shown in FIG. 6. The cam protrusion 143*c* is rotated by the motor 141 to push the follower 125, as shown in FIG. 7. When the hook 60 is released, and, as a result, the door 30 is opened, as shown in FIG. 8, the cam protrusion 143*c* preferably returns to the original position thereof.

The follower 125 is rectilinearly moved by the cam 143. The follower 125 is moved forward by the cam protrusion 143*c* of the cam 143. The follower 125 is moved backward by the switch elastic member 123. The follower 125 is preferably slidably coupled to the upper switch body 131. The follower 125 has a follower rotation shaft 125*a*, which is preferably coupled in a lever hole 121*a* formed in the lever 121.

The motor 141, the cam 143, and the follower 125 may be referred to as a lever driver for driving the lever 121.

The lever 121 is driven by the follower 125 to push the hook 60 such that the hook 60 is released from the door switch 100. The lever 121 has a lever rotation shaft 121*b*, which is preferably coupled in an upper switch hole 131*b* formed in the upper switch body 131. The lever 121 is rotated by the follower 125 to push a hook head 63 of the hook 60 such that the hook 60 is rotated.

Hereinafter, the operation of the door switch 100 with the above-stated construction according to this embodiment will be described.

When laundry treatment is completed by the laundry treatment apparatus 1, the motor 141 rotates the cam 143. When the cam 143 is rotated, the cam protrusion 143*c* of the cam 143 pushes the follower 125 such that the follower 125 performs a rectilinear motion. When the follower 125 is moved forward, the lever 121 is rotated to push the hook head 63 of the hook 60. When the hook head 63 is pushed, the hook 60 is rotated.

When the hook 60 is rotated, the hook latch part 61 is released from the switch latch part 115, with the result that the hook 60 is released from the door switch 100. When the hook 60 is released from the door switch 100, the support elastic member 44 of the support unit 40 applies elastic force to the support body 41 such that the door 30 is rotated, whereby the door 30 is opened. At this time, the door 30 may be rotated by elastic force of the door elastic member 39.

Since the support body 41 is in contact with the door receiving part 23 of the cabinet 10 by magnetic force of the magnet 45 of the support unit 40, the door 30 is opened merely by the separation gap 50.

When the hook 60 is separated from the door switch 100, and, as a result, the door 30 is opened, the follower 125 is preferably moved backward by the switch elastic member 123 such that the lever 121 returns to the original position thereof.

When the door 30 is not opened for a long period of time without laundry treatment, the door 30 of the laundry treat apparatus 1 may be automatically opened in the same method as when the laundry treatment is completed as described above.

Figure 9:
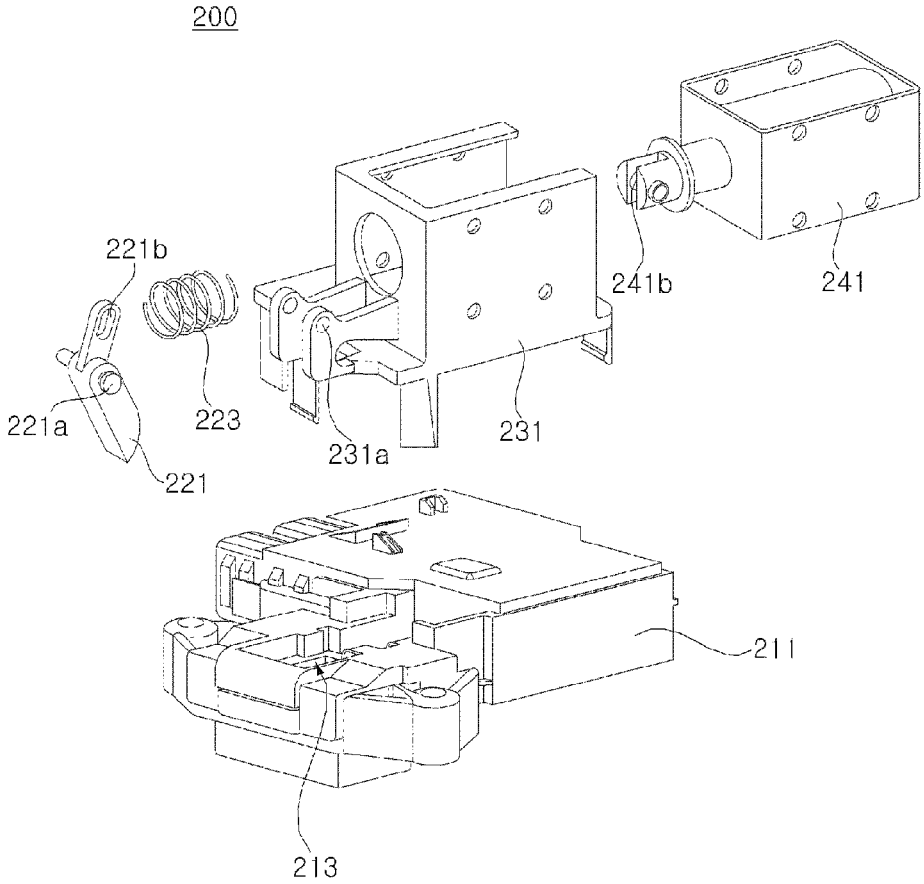
FIG. 9 is an exploded perspective view showing a door switch of a laundry treating apparatus according to another embodiment of the present invention.
Figure 10:
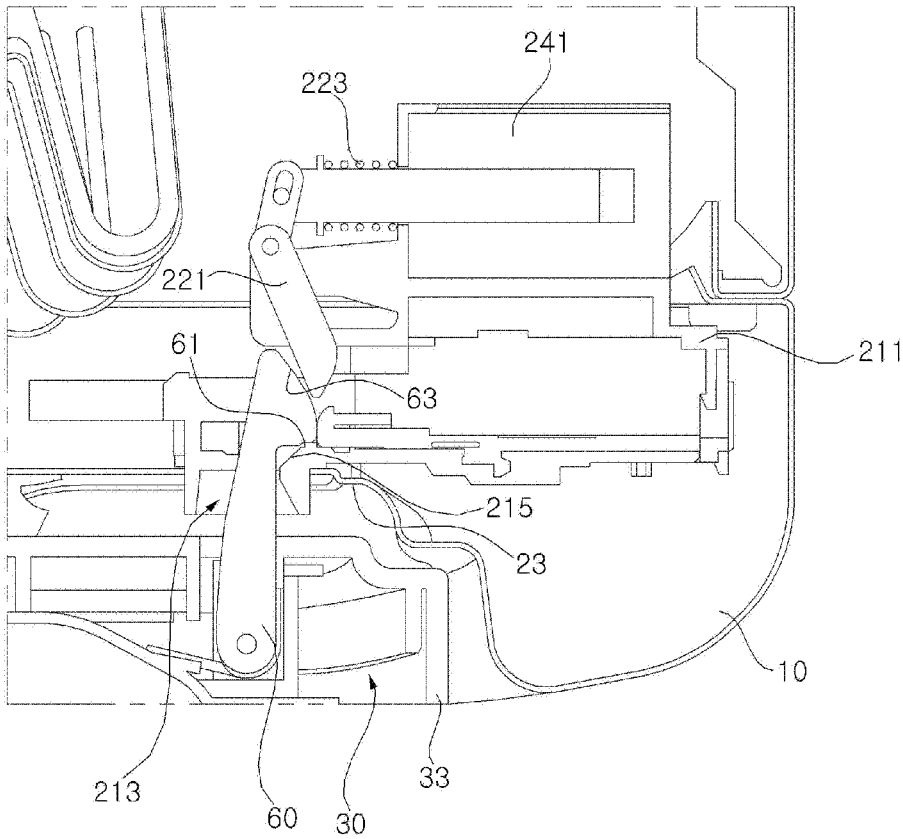
FIG. 10 is a view showing a hook latched to the door switch of FIG. 9.
Figure 11:
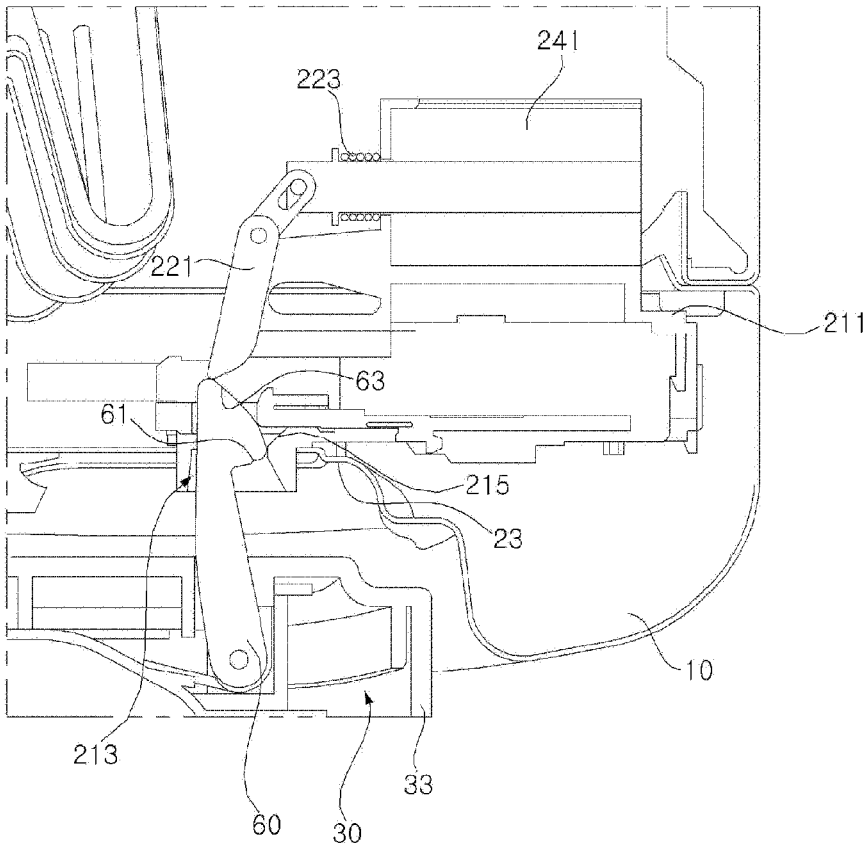
FIG. 11 is a view showing the door switch of FIG. 9 releasing the hook.
Figure 12:
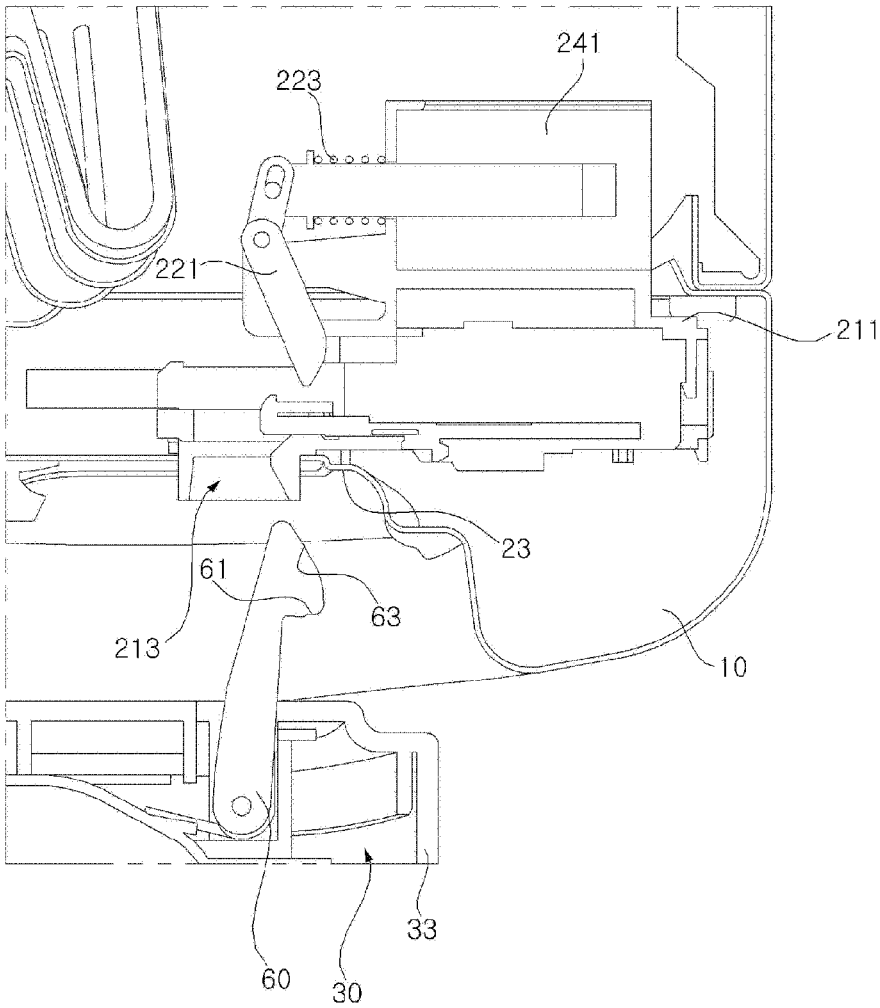
FIG. 12 is a view showing a door being opened as a result of the separation of the hook from the door switch of FIG. 9.

FIG. 9 is an exploded perspective view showing a door switch of a laundry treating apparatus according to another embodiment of the present invention, FIG. 10 is a view showing a hook latched to the door switch of FIG. 9, FIG. 11 is a view showing the door switch of FIG. 9 releasing the hook, and FIG. 12 is a view showing a door being opened as a result of the separation of the hook from the door switch of FIG. 9.

In this embodiment, a door switch 200 includes a lower switch body 211 to which the hook 60 is latched, an upper switch body 231 coupled to the lower switch body 211, a solenoid 241 for generating rectilinear force, and a lever 221 driven by the solenoid 241 for releasing the hook 60.

A description is omitted with respect to components of the door switch 200 according to this embodiment similar to those of the door switch 100 according to the previous embodiment.

The solenoid 241 generates rectilinear force to move the lever 221. When the door 30 is closed, the solenoid 241 protrudes as shown in FIG. 10. When an electric signal is inputted, the solenoid 241 is moved backward, as shown in FIG. 11, to pull the lever 221. When the hook 60 is separated, and, as a result, the door 30 is opened, as shown in FIG. 11, the solenoid 241 preferably returns to the original position thereof by a solenoid elastic member 223. The solenoid 241 has a solenoid rotation shaft 241*b*, which is preferably coupled in a lever hole 221*b* formed in the lever 221.

The lever 221 is driven by the solenoid 241 to push the hook 60 such that the hook 60 is released. The lever 121 has a lever rotation shaft 221*a*, which is preferably rotatably coupled in an upper switch hole 231*a* formed in the upper switch body 231. The lever 221 is rotated by the solenoid 241 to push the hook head 63 of the hook 60 such that the hook 60 is rotated.

Hereinafter, the operation of the door switch 200 with the above-stated construction according to this embodiment will be described.

When laundry treatment is completed by the laundry treatment apparatus 1, the solenoid 241 is rectilinearly moved backward. As a result, the lever 221 is rotated to push the hook head 63 of the hook 60. When the hook head 63 is pushed, the hook 60 is rotated.

When the hook 60 is rotated, the hook latch part 61 is released from a switch latch part 215, with the result that the hook 60 is separated from the door switch 200. When the hook 60 is separated from the door switch 100, the support elastic member 44 of the support unit 40 applies elastic force to the support body 41 such that the door 30 is rotated, whereby the door 30 is opened. At this time, the door 30 may be rotated by elastic force of the door elastic member 39.

Since the support body 41 is in contact with the door receiving part 23 of the cabinet 10 by magnetic force of the magnet 45 of the support unit 40, the door 30 is opened merely by the separation gap 50.

When the hook 60 is separated from the door switch 200, and, as a result, the door 30 is opened, the solenoid 241 is preferably moved forward by a solenoid elastic member 223 such that the lever 221 returns to the original position thereof.

Figure 13:
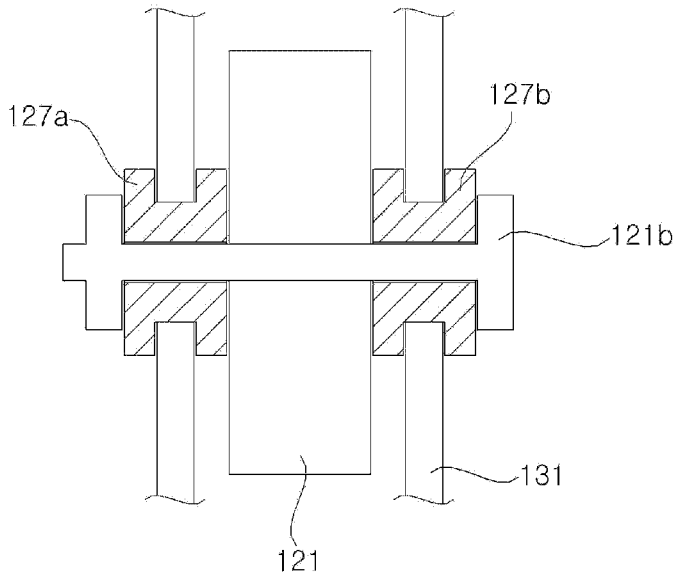
FIG. 13 is a sectional view showing a lever rotation shaft coupling region of a door switch of a laundry treating apparatus according to an embodiment of the present invention.
Figure 14:
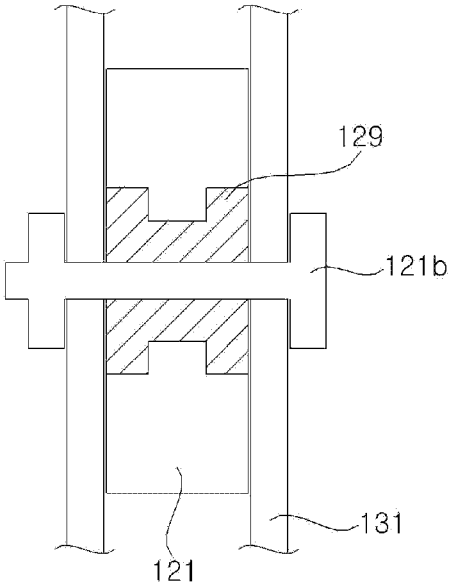
FIG. 14 is a sectional view showing another embodiment of a lever rotation shaft coupling region of a door switch.

FIG. 13 is a sectional view showing a lever rotation shaft coupling region of a door switch of a laundry treating apparatus according to an embodiment of the present invention, and FIG. 14 is a sectional view showing another embodiment of a lever rotation shaft coupling region of a door switch.

If the lever 121 does not return to the original position thereof after the door 30 is opened as shown in FIG. 8 or FIG. 12, the hook 60 may impact with the lever 121 or 221 when the door 30 is closed subsequently, with the result that the lever rotation shaft 121*b* (or the follower rotation shaft 125*a*) or the solenoid rotation shaft 241*b* may be damaged. In order to prevent the occurrence of this problem, a rotation shaft elastic member is preferably provided around the rotation shaft to absorb the impact. The rotation shaft elastic member is preferably made of rubber.

Referring to FIG. 13, a first rotation shaft elastic member 127*a* and a second rotation shaft elastic member 127*b* may be provided between the lever rotation shaft 121*b* and the upper switch body 131. Referring to FIG. 14, a third rotation shaft elastic member 129 may be provided between the lever rotation shaft 121*b* and the lever 121.

In addition to the lever rotation shaft 121*b*, the follower rotation shaft 125*a* or the solenoid rotation shaft 241*b* may be provided with a rotation shaft elastic member as in FIG. 13 or FIG. 14.

Figure 15:
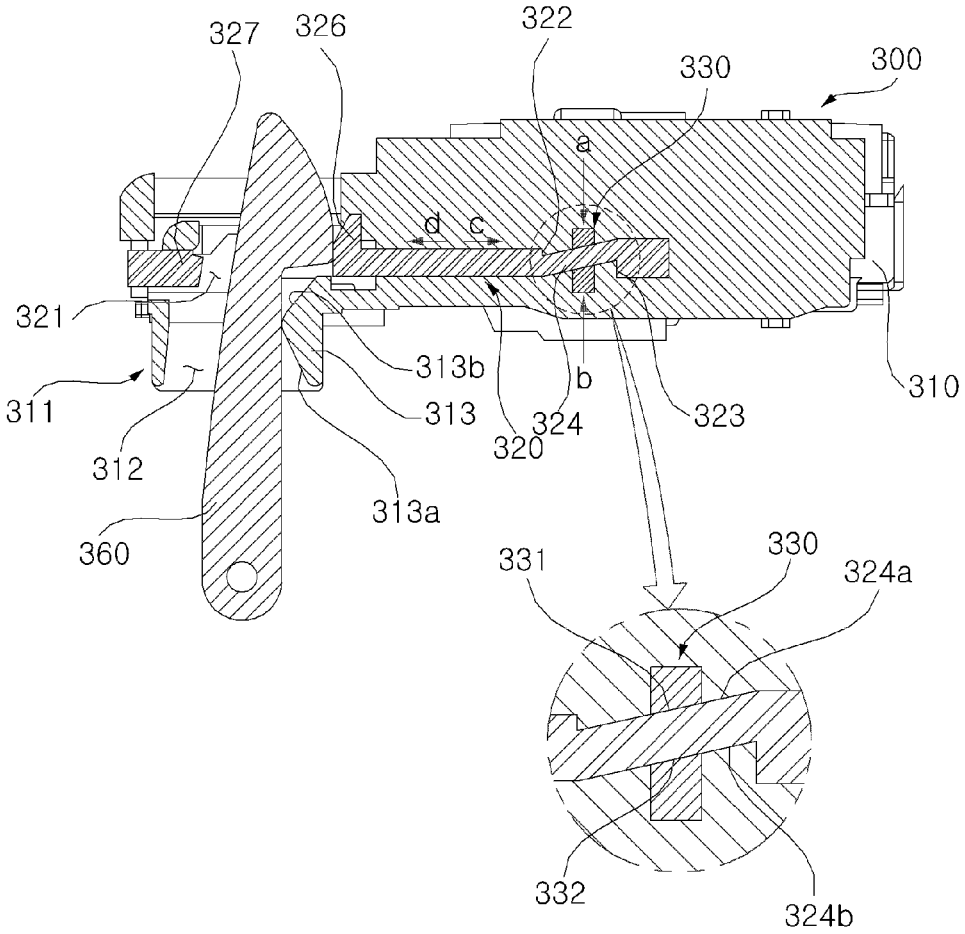
FIG. 15 is a sectional view showing a coupling structure between a hook and a door switch where a door of a laundry treating apparatus according to another embodiment of the present invention is lock released.

FIG. 15 is a sectional view showing a coupling structure between a hook and a door switch where a door of a laundry treating apparatus according to another embodiment of the present invention is lock released.

Referring to FIG. 15, a door switch 300 includes a switch body 310 forming an external appearance thereof, the switch body 310 having a hook insertion part 311 into which the hook 360 is inserted, a slider 320 slidably provided in the switch body 310 for rotating the hook 360 to lock, lock release, or automatically open the door 30, and a slider actuator 330 for transmitting force from a driver, which will be described later, to the slider 320 to actuate the slider 320.

Although not shown in FIG. 15, the driver may be disposed in the switch body 310. Alternatively, the driver may be disposed outside the switch body 310 to transmit driving force to the slider actuator 330 through an additional connection member, such as a link (not shown). Exemplary embodiments of the driver will be described later with reference to FIGS. 18 and 19. The hook insertion part 311 may include a hook insertion hole 312 and a hook latch part 313 formed around the hook insertion hole 312 in a protruding shape such that the hook 360 is latched to the hook latch part 313.

The hook latch part 313 may have an insertion inclined plane 313*a* formed in an inclined shape such that the hook 360 is smoothly inserted when the door 30 is closed and a release inclined plane 313*b* formed in an inclined shape reverse to the inclined shape of the insertion inclined plane 313*a* such that the hook 360 is smoothly released when the door 30 is opened.

The slider 320 may include a slider inclined plane 324 inserted into the slider actuator 330 for converting the direction of force applied from the slider actuator 330 as the slider actuator 330 moves upward and downward such that the slider 320 moves left and right, a first stopper 322 configured to be latched to the slider actuator 330 for limiting the movement distance of the slider 320 in the right direction, and a second stopper 323 configured to be latched to the slider actuator 330 for limiting the movement distance of the slider 320 in the left direction.

The slider actuator 330 may include a first actuator part for applying force to the slider 320 during downward movement and a second actuator part for applying force to the slider 320 during upward movement. Referring to FIG. 15, in this embodiment, the first actuator part includes a first actuation plane 331 configured to be in plane contact with the slider inclined plane 324 of the slider 320 for generating sufficient frictional force. In the same manner, the second actuator part may include a first actuation plane 332.

The slider 320 may include a first conversion plane 324*a* corresponding to the first actuation plane 331 and a second conversion plane 324*b* corresponding to the second actuation plane 332 for converting the direction of force applied from the slider actuator 330, when the slider actuator 330 moves upward and downward, such that the slider 320 moves left and right.

Hereinafter, the movement direction of the slider 320 or the slider actuator 330 will be described. In FIG. 15, the downward direction is indicated by an arrow a (direction a), the upward direction is indicated by an arrow b (direction b), the right direction is indicated by an arrow c (direction c), and the left direction is indicated by an arrow d (direction d). Direction c is a direction in which the slider 320 moves to rotate the hook 360 such that the door 30 is locked. Direction d is a direction in which the slider 320 moves to rotate the hook 360 such that the door 30 is lock released/automatically opened. Direction a is a direction in which the slider actuator 330 moves to move the slider 320 in direction c. For example, direction a may be a direction in which the slider actuator 330 is not perpendicular to but at a predetermined angle to the first conversion plane 324*a* formed at the slider 320. Direction b is a direction in which the slider actuator 330 moves to move the slider 320 in direction d. For example, direction b may be a direction in which the slider actuator 330 is not perpendicular to but at a predetermined angle to the second conversion plane 324*b* formed at the slider 320.

A state in which the door 30 is lock released is a state in which the door 30 is closed such that a user opens the door using the door handle 72. In the state in which the door 30 is lock released, the hook 360 is latched to the hook latch part 313. However, a separation gap 321 is formed between the hook 360 and the slider 320, with the result that the hook 360 escapes through the separation gap 321, while being rotated, by the manipulation of the door handle 72.

Meanwhile, when the slider actuator 330 moves in direction a in the state in which the door 30 is lock released, the slider 320 moves in direction c to lock the door 30. On the other hand, when the slider actuator 330 moves in direction b, the door 30 is automatically opened. The locking and automatic opening of the door 30 will hereinafter be described in detail with reference to FIGS. 16 and 17.

Figure 16:
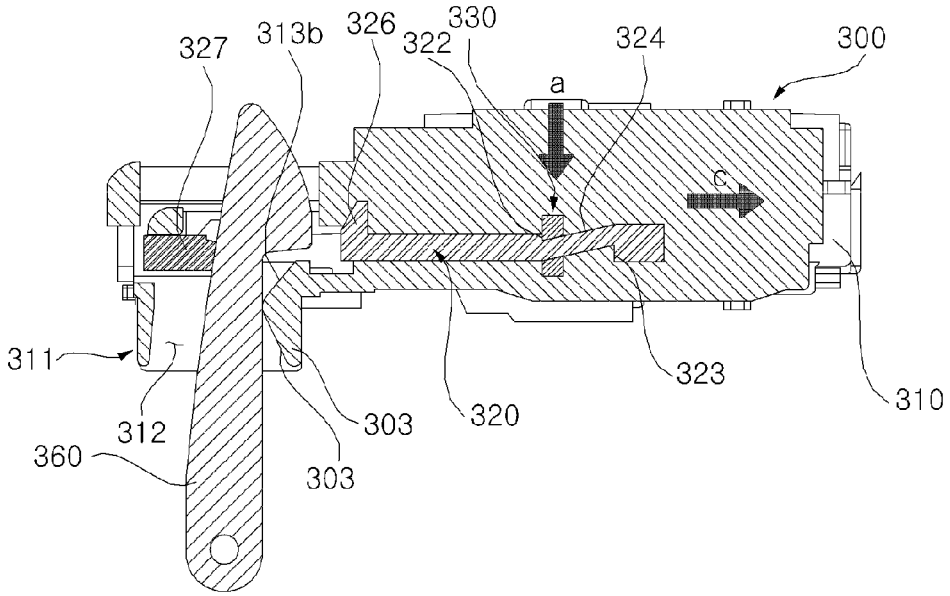
FIG. 16 is a sectional view showing a coupling structure between a hook and a door switch where a door of a laundry treating apparatus according to another embodiment of the present invention is locked.

FIG. 16 is a sectional view showing a coupling structure between a hook and a door switch where a door of a laundry treating apparatus according to another embodiment of the present invention is locked.

Referring to FIGS. 15 and 16, when the slider actuator 330 is moved in direction a, the slider 320 moves in direction c, whereby the hook is constrained by a hook constraint part 327 formed at one end of the slider 320 such that the hook 360 is not released from the hook latch part 313.

At this time, force applied from the first actuation plane 331 of the slider actuator 330 is converted into c direction force by the first conversion plane 324*a* of the slider 320 to move the slider 320 in direction c. After the slider 320 moves a predetermined distance in direction c, the first stopper 322 is latched to the slider actuator 330, whereby the movement distance of the slider 320 in direction c is limited.

Figure 17:
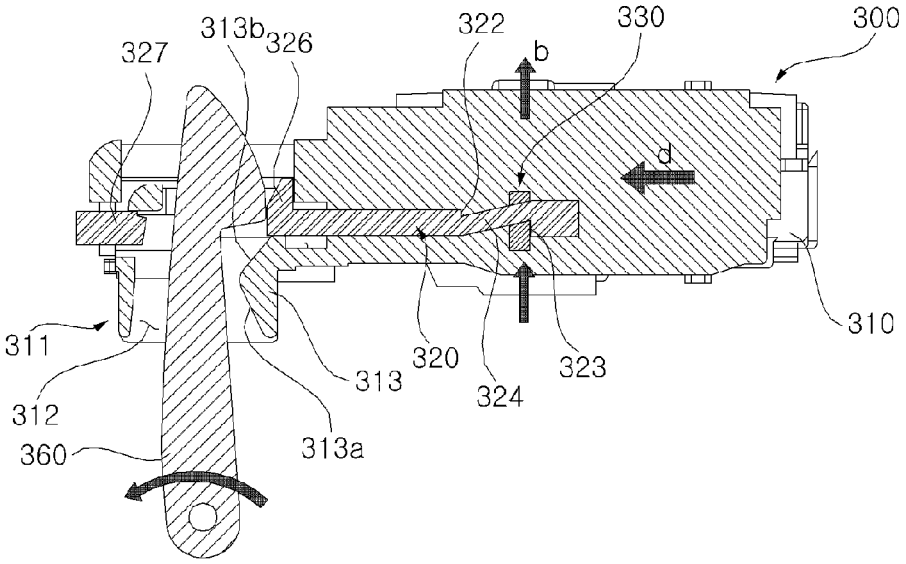
FIG. 17 is a sectional view showing a coupling structure between a hook and a door switch where a door of a laundry treating apparatus according to another embodiment of the present invention is automatically opened.

FIG. 17 is a sectional view showing a coupling structure between a hook and a door switch where a door of a laundry treating apparatus according to another embodiment of the present invention is automatically opened.

Referring to FIGS. 15 and 17, when the slider actuator 330 is moved in direction b, the slider 320 moves in direction d. Consequently, a hook release part 326 formed at one end of the slider 320 pushes the hook 360, whereby the hook 360 is rotated in the counterclockwise direction, with the result that the hook 360 is released from the hook latch part 313. At this time, the door 30 is automatically rotated in the direction in which the door 30 is opened by elasticity of the door elastic member 39 and the support unit 40 provided in the door 30, with the result that the hook 360 is released from the door switch 300.

At this time, force applied from the second actuation plane 332 of the slider actuator 330 is converted into d direction force by the second conversion plane 324*b* of the slider 320 to move the slider 320 in direction d. After the slider 320 moves a predetermined distance in direction d, the second stopper 323 is latched to the slider actuator 330, whereby the movement distance of the slider 320 in direction d is limited.

At this time, the door 30 is not completely opened but is restrictively opened since the support unit 40 is attached to the door location part 23 by magnetism of the magnet 45 provided at the support unit 40.

So as to restrictively open the door 30 as described above, it is necessary for the door elastic member 30 and the support elastic member 44 to have appropriate coefficients of elasticity and for the magnet 45 to have appropriate magnetism.

Figure 18:
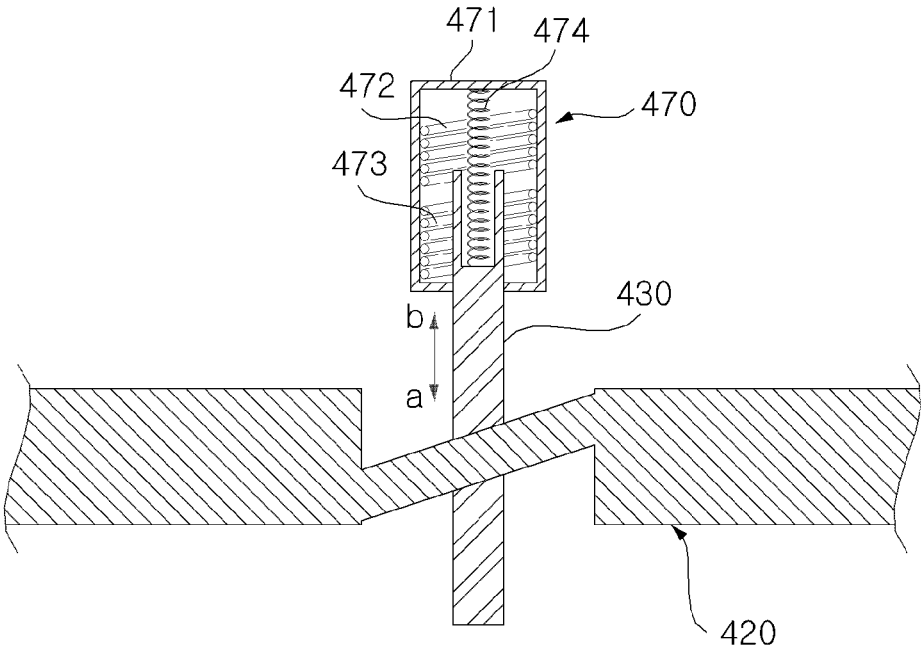
FIG. 18 is a sectional view showing an embodiment of a driver applicable to a laundry treating apparatus according to another embodiment of the present invention.

FIG. 18 is a sectional view showing an embodiment of a driver applicable to a laundry treating apparatus according to another embodiment of the present invention.

Referring to FIG. 18, the driver may be variously embodied by a device for providing driving force to move the slider actuator 430 in direction a or direction b (see FIG. 15). For example, the slider actuator 430 may be manually actuated by a link mechanism, or the slider actuator 430 may be electrically actuated by a motor or an actuator.

In this embodiment, the driver is embodied by a dynamic device using a solenoid. In this embodiment, the driver 470 includes a first coil 472 and a second coil 473 provided in the driver body 471. The slider actuator 430 is movably disposed inside the first coil 472 and the second coil 472 such that the slider actuator 430 moves by current flowing in the first coil 472 and/or the second coil 473. The slider actuator 430 is preferably formed with a conductor.

At this time, the movement distance of the slider actuator 470 varies depending upon a state in which current flows in the first coil 472 or the second coil 473. In a state in which current flows in the first coil 472 but not in the second coil 473, force to move the slider actuator 430 is generated only by the first coil 472. When current simultaneously flows in the first coil 472 and the second coil 473, force to move the slider actuator 430 is generated by the first coil 472 and the second coil 473. Consequently, the movement direction of the slider actuator 430 is greater when current simultaneously flows in the first coil 472 and the second coil 473 than when current flows in the first coil 472 or the second coil 473. It is possible to limit the movement distance of the slider actuator 430 in direction a, such that the door 30 is lock released (see FIG. 15) or locked (see FIG. 16), using such properties.

Meanwhile, the driver 470 may further include a drive elastic member 474 for providing restoring force to return the slider actuator 470 to the original position thereof when the supply of current to the coils 472 and 473 is interrupted when the slider actuator 430 is moved in direction a.

On the other hand, when the supply of current to the second coil 473 is interrupted when the door 30 is locked, the slider actuator 430 is moved in direction b to lock release the door 30 (see FIG. 15). When the supply of current to the first coil 472 is also interrupted, the slider actuator 430 is further moved in direction b to automatically open the door 30 (see FIG. 17).

In this embodiment, the driver 470 includes a plurality of coils, and the supply of current to the respective coils is controlled to move the slider actuator 470 in stages. However, a method of moving the slider actuator 470 in stages using the solenoid is not limited thereto. For example, it is possible to move the slider actuator 470 in stages by controlling intensity of current flowing in one of the coils to control the magnitude of magnetic force.

Figure 19:
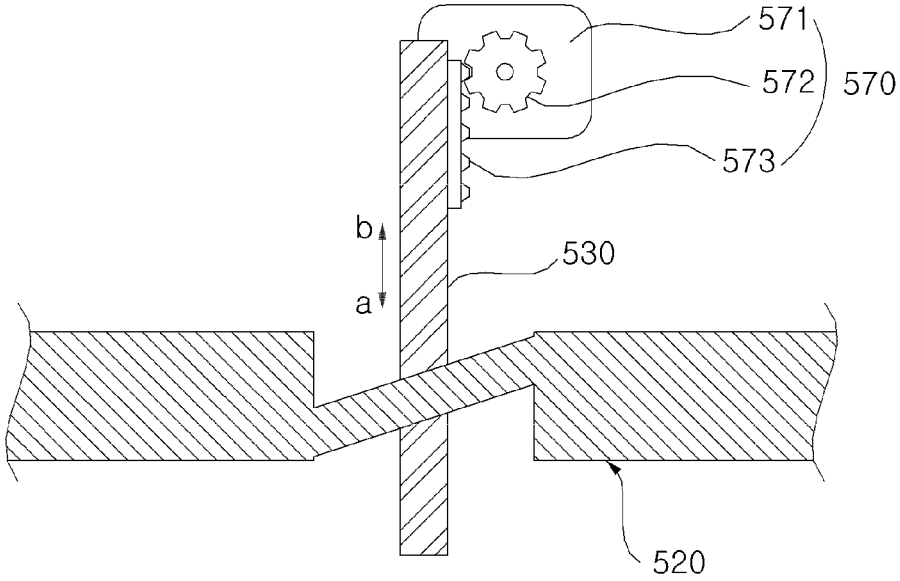
FIG. 19 is a sectional view showing another embodiment of a driver applicable to a laundry treating apparatus according to another embodiment of the present invention.

FIG. 19 is a sectional view showing another embodiment of a driver applicable to a laundry treating apparatus according to another embodiment of the present invention. Referring to FIG. 19, a driver 570 according to this embodiment is embodied by a rack and pinion device.

More specifically, the driver 570 includes a motor 571 for providing rotational force, a pinion 572 configured to be rotated by the motor 571, and a rack 573 provided at the slider actuator 430 for engaging with the pinion 472.

When the pinion 572 is rotated by the motor 571, the slider actuator 530 is moved by the motion of the rack 473 engaging with the pinion 572. In the same manner as in the previous embodiment, the rotation of the motor 571 is preferably controlled to control the movement distance of the slider actuator 570.

Meanwhile, the slider actuator may be embodied by a cam device for converting rotational movement into reciprocating movement in addition to the previous embodiments. The cam device may be constructed so as to control the displacement of the follower performing reciprocating movement in stages such that the slider actuator is moved in stages.

Figure 20:
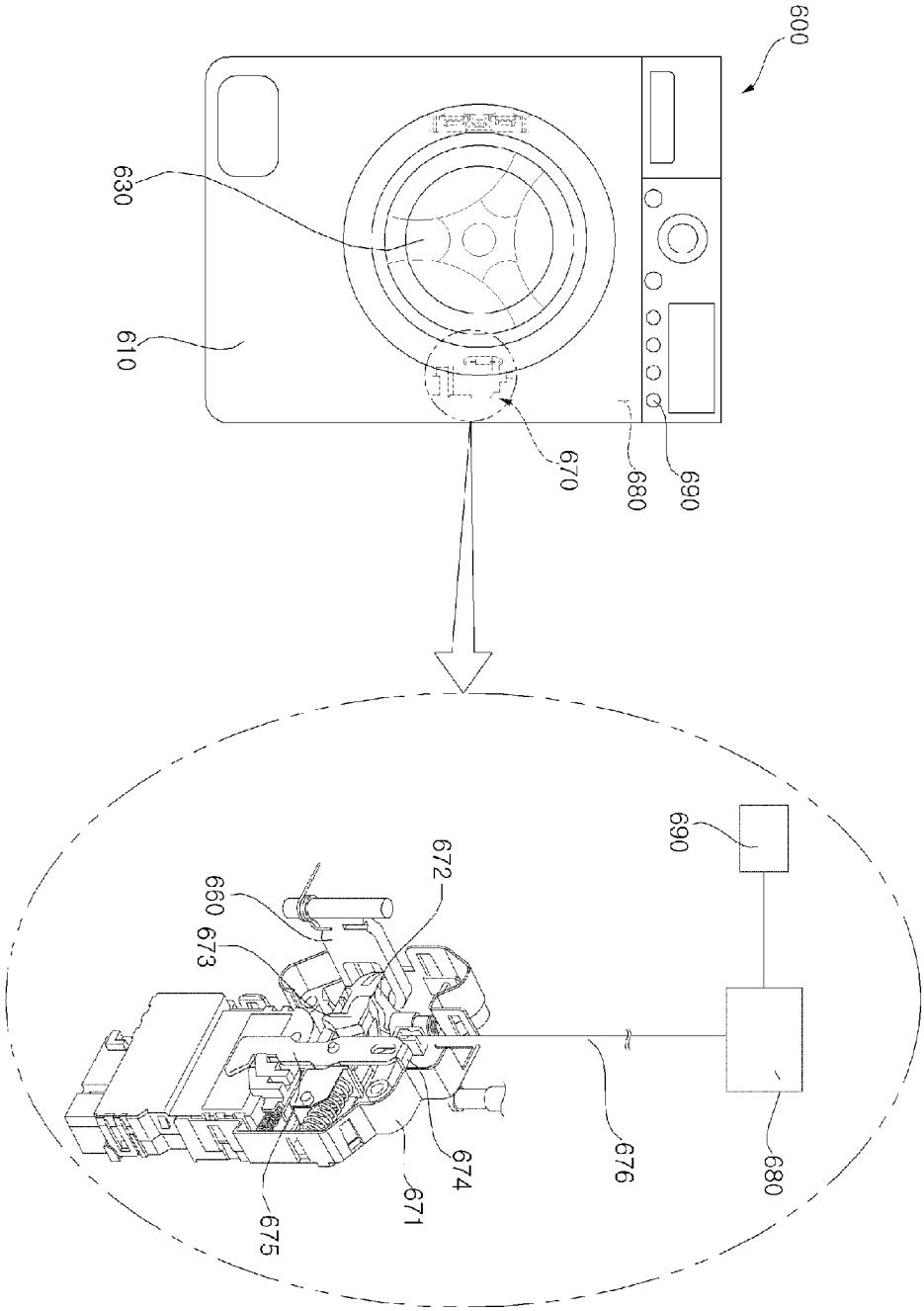
FIG. 20 is a typical view showing a laundry treating apparatus and a door switch for locking or lock releasing a door according to another embodiment of the present invention.

FIG. 20 is a typical view showing a laundry treating apparatus and a door switch according to another embodiment of the present invention.

In a laundry treating apparatus 600 according to this embodiment, a hook 660 is disposed at the rear of a door 630. The hook 660 is latched to a door switch 670 for closing the door 630 to prevent the door 630 from being opened and, in addition, to prevent wash water from leaking out of a cabinet 610 of the laundry treating apparatus 601 during washing.

The door switch 670 holds the tip end of the hook 660 to prevent the other end of the door 630 from being rotatably opened when the hook 660 reaches a position where the hook 660 is latched to the door switch 670 as the door 630 is closed to perform washing in the laundry treating apparatus 601.

When the washing in the laundry treating apparatus 601 is completed, the hook 660 is released from the door switch 670 such that the other end of the door 630 rotatably opens.

More specifically, as shown in FIG. 20, the door switch 670 includes a door switch body 671 mounted at the side of the cabinet 610 corresponding to the other end of the door 630, a latch part 672 rotatably disposed at the door switch body 671 for latching or latch releasing the hook 660 when a laundry entrance opening 621 is closed by the door 630, a stopper 673 movable upward and downward disposed at the door switch body 671, such that the stopper 673 contacts the latch part 672, for stopping the rotation of the latch part 672 or releasing the latch part 672 by the upward and downward movement thereof, a moving rod 675 having one end connected to the stopper 673 and the other end connected to a manipulation rod 674 for moving the stopper upward and downward, the moving rod 675 being operatively connected to the manipulation rod 674 such that the moving rod 675 is moved simultaneously when the manipulation rod 674 is moved, the manipulation rod 674, and an actuator 680 connected to the manipulation rod 674 via a wire 676 for moving the manipulation rod 674 upward and downward.

The actuator 680 is configured to be fully automatically operated according to an electric signal from a button manipulation part 690 disposed at the upper part of the front of the cabinet 610 of the laundry treating apparatus 601. The button manipulation part 690 is preferably disposed at the upper part of the front of the cabinet 610 such that a user easily manipulates the button manipulation part 690.

The operation of the door switch 670 with the above-stated construction will be described in brief. When a user manually manipulates the button manipulation part 690 to lock release the door 630, the wire 676 is pulled upward by the actuator 680, which is actuated fully automatically. At this time, the manipulation rod 674, connected to the wire 676, is moved upward from the door switch body 671 to move the moving rod 675 upward and thus moving the stopper 673 connected to the moving rod 675. As a result, the latch part 672 is rotated, and therefore, the hook 660 is released from the latch part 672.

Figure 21:
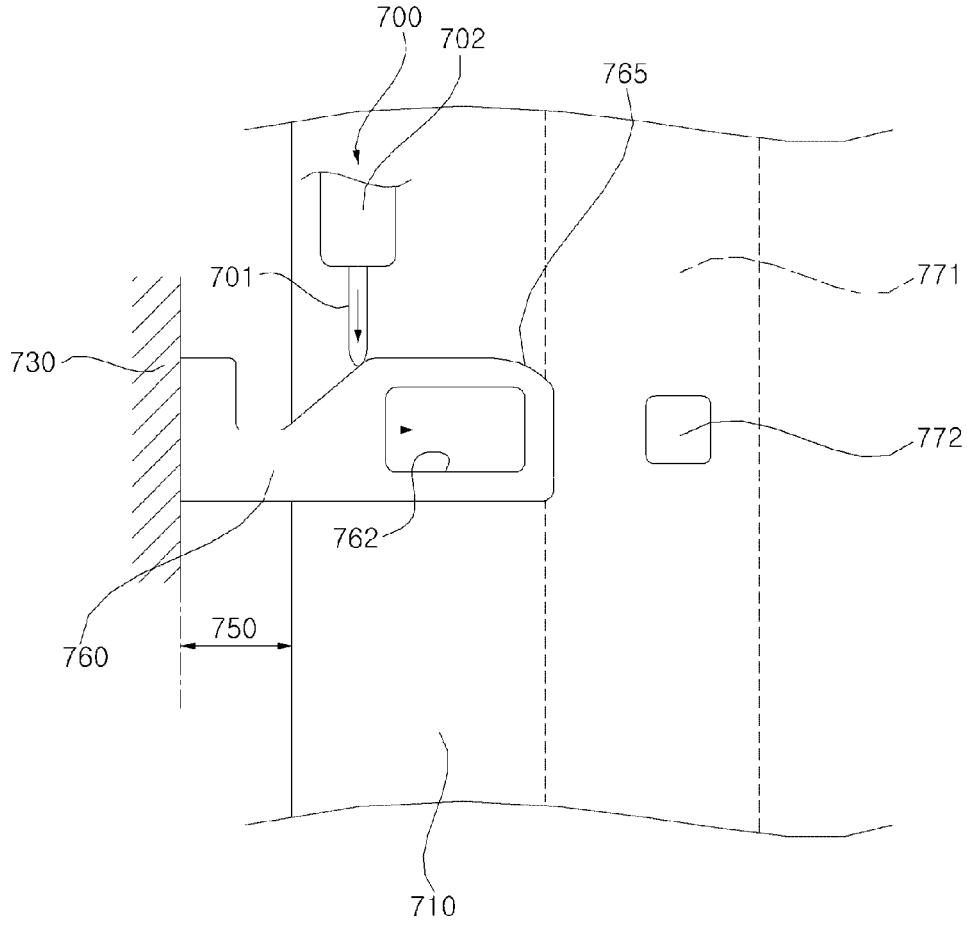
FIG. 21 is a typical view showing a support unit of a laundry treating apparatus according to another embodiment of the present invention.
Figure 22:
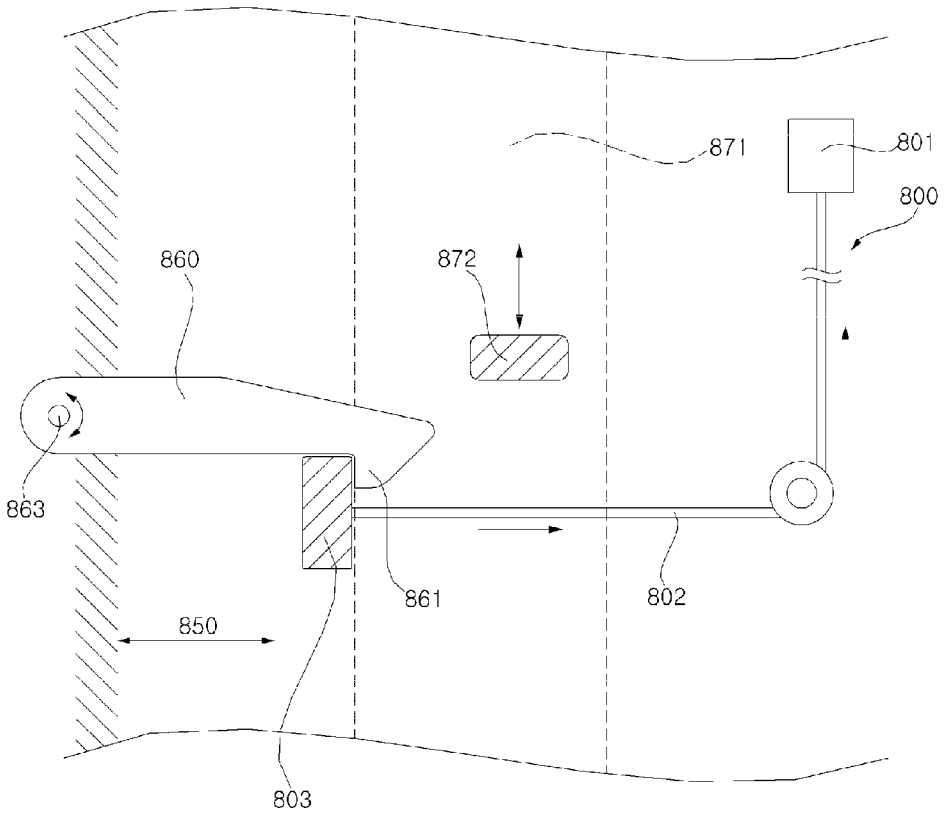
FIG. 22 is a typical view showing a support unit of a laundry treating apparatus according to a further embodiment of the present invention.

FIG. 21 is a typical view showing a door switch of a laundry treating apparatus according to another embodiment of the present invention, and FIG. 22 is a typical view showing a door switch of a laundry treating apparatus according to a further embodiment of the present invention.

In this embodiment, as shown in FIG. 21, the laundry treating apparatus includes a door switch 700 for moving a hook 760 horizontally and thus moving the door 730 to form a separation gap 750 defined between the door 730 and a cabinet 710 of the laundry treating apparatus for achieving communication between the interior and exterior of the cabinet 710.

The door switch 700 may include a contact rod 701 configured to contact the hook 760 at a position before the hook 760 is latched to the door switch 770 for moving the hook 760 to a latch position and an actuator 702 for moving the contact rod 701 to the latch position.

Also, the contact rod 701 moves perpendicularly to the movement path of the hook 760 while being in slidingly contact with the outside of the hook 760.

Hereinafter, a process of moving the hook 760 to the latch position by the contact rod 701 will be described in more detail.

In a stopped state, the contact rod 701 is disposed on the movement path of the hook 760. When the hook 760 approaches the contact rod 701, a tip end 765 of the hook 760 makes contact with the contact rod 701.

That is, when a user pushes the door 730 toward the cabinet 710, the tip end 765 of the hook 760 comes into contact with the contact rod 701. When the user further pushes the door 730 toward the cabinet 710, the contact rod 701 moves to the middle of the hook 760 in slidingly contact with the tip end 765 of the hook 760 and reaches a stop position of the hook 760.

At the stop position, the door 730 is stopped by the contact rod 701 to form the predetermined separation gap 750 between the cabinet 710 and the door 730, thereby achieving objects of the laundry treating apparatus in accordance with the disclosure.

In a standstill period in which the laundry treating apparatus is not in use, therefore, the separation gap 750 is formed by the door switch 700 to achieve communication between the interior and the exterior of the laundry treating apparatus, thereby preventing the propagation of germs and mold in the interior of the laundry treating apparatus.

When a user wishes to close the door 730 for performing washing in the laundry treating apparatus at the stop position, the user actuates the actuator 702 to move the contact rod 701.

Consequently, the contact rod 701 moves while being in slidingly contact with the hook 760 in a state in which the contact rod 701 is in contact with a latch position of the hook 760 to move the hook 760 in the movement path. As a result, the hook 760 is moved to the latch position.

Hereinafter, a process of moving the hook 760 from the latch position to the stop position will be described in more detail.

When a user manually or automatically converts a locked state of the door 730 into a lock released state of the door 730, the latch part 772 is rotated, and therefore, the hook 760 is released from the latch part 772.

At the same time, the actuator 702 is preferably actuated to move the contact rod 701 to the stop position.

When the hook 760 is released from the latch part 772, the door 730 is moved forward by elastic force of a door elastic member, and the hook 760 comes into contact with the contact rod 701 moved to the latch position, with the result that the hook 760 is latched to the contact rod 701. At this time, the predetermined separation gap 750 for achieving communication between the interior and the exterior of the laundry treating apparatus is formed/maintained between the cabinet 710 and the door 730.

When a user pulls a grip (not shown) provided at the front of the door 730 forward to put laundry into the interior of the laundry treating apparatus, the contact rod 701 moves over the tip end 765 of the hook 760 in slidingly contact, with the result that the latch between the contact rod 701 and the hook 760 is released, whereby the door 730 is completely opened.

In a laundry treating apparatus according to a further embodiment of the present invention, as shown in FIG. 22, a hook 860 may have a tip end 861 formed in the shape of a hook.

The hook 860 is provided at the rear of a door 830 such that the tip end 861 of the hook 860 protrudes toward a cabinet 810 of the laundry treating apparatus.

Specifically, the hook 860 is rotatably coupled to a second hinge coupling part 863 disposed at the rear of the door 830 such that the tip end 861 of the hook 860 is rotated by a predetermined angle about the second hinge coupling part 863.

The hook 860 may be operatively connected to a grip (not shown) mounted at the front of the door 830 such that the hook 860 is rotated about the second hinge coupling part 863.

A support elastic member (not shown) exhibiting predetermined elastic force may be provided at the second hinge coupling part 863. When any external force is transmitted to the hook 860, and, as a result, the tip end 861 of the hook 860 is rotated about the second hinge coupling part 863, the support elastic member serves to provide restoring force by which the tip end 861 of the hook 860 returns to the original position thereof.

Meanwhile, as shown in FIG. 22, the door switch 800 may include a latch part 803 configured to move along the same movement path as the hook 860 and to be latched to the tip end 861 of the hook 860 for moving the hook 860 along the movement path and an actuator 801 connected to the latch part 803 via a wire 802, the actuator 801 being configured to wind the wire 802.

The tip end 861 of the hook 860 may be formed with a latch protrusion configured to be latched to the latch part 803 when the latch part 803 moves along the movement path.

Hereinafter, a process of moving the hook 860 from the latch position to the closed position by the door switch 800 will be described in more detail.

In a stopped state, the latch part 803 is disposed on the movement path of the hook 860. When the hook 860 approaches the latch part 803, the tip end 861 of the hook 860 comes into contact with the latch part 803.

When a user pushes the door 830 toward the cabinet 810, the tip end 861 of the hook 860 is latched to the latch part 803.

When the user further pushes the door 830 toward the cabinet 810, the hook 860 moves over the latch part 803 in slidingly contact while the tip end 861 of the hook 860 is rotated about the second hinge coupling part 863, with the result that the hook 860 moves to the latch position where the latch part 803 is latched to the latch protrusion of the hook 860. The tip end 861 of the hook 860 with which the latch part 803 is in contact may be formed in an inclined shape for easy slidingly contact.

When the user applies no external force in a state in which the latch part 803 is latched at the latch position, force to rotatably rotate the door 830 forward is applied to the door by elastic force of a door elastic member 839 of the door 830, with the result that a separation gap 850 is formed in a normal state, i.e., in a state in which the hook 860 is not latched.

When the user wishes to close the door 830 for performing washing in the laundry treating apparatus at the latch position, the user further moves the latch part 803 along the movement path of the hook 860.

In a state in which the hook 860 is latched to the latch part 802, therefore, the latch part 802 moves the hook 860 to the closed position to move the door 830 backward.

At the closed position is located a latch part 872 disposed on a rotational path of the hook 860. The hook 860 is latched to the latch part 803 at the closed position, and, at the same time, the rotation of the hook 860 is prevented by the latch part 872, thereby achieving a closed state.

Hereinafter, a process of moving the hook 860 from the closed position to the latch position will be described in more detail.

When a user manipulates to release the locked door 830, the drive motor 801 may be operated such that the wire 802, wound by predetermined external force, is unwound.

At this time, when the user pulls the grip provided at the front of the door 830 forward to open the door 830, the wire 802 wound by the drive motor 801 is unwound, with the result that the tip end 861 of the hook 860 is moved forward while being latched to the latch part 803. At this time, the hook 860 is moved from the closed position to the latch position, with the result that the separation gap 850 is formed.

In addition, complete opening may be necessary for the user to put laundry into the laundry treating apparatus. When the user pulls the grip forward, the tip end 865 of the hook 860 is rotated about the second hinge coupling part 863. At this time, the latch between the tip end 865 of the hook 860 and the latch part 103 is released, and therefore, the door 830 opens completely.

It will be understood by those skilled in the art that example embodiments can be implemented in other specific forms. Therefore, it should be noted that the forgoing embodiments are merely illustrative in all aspects and are not to be construed as limiting the invention. All changes or modifications or their equivalents should be construed as falling within the scope of the claims.

According to the laundry treating apparatus of the disclosure, one or more effects as follows may be achieved.

First, the door is automatically opened when the treatment of laundry is completed.

Second, the door is automatically opened using the door closing structure.

Third, locking, lock releasing, and automatic opening of the door are achieved through the door switch, the structure of which is simplified.

Fourth, the door is automatically opened while the predetermined separation gap between the door and the cabinet is maintained without complete opening of the door.

Fifth, damage to the parts for automatically opening the door is prevented when the door is closed.

Sixth, impact when the door is closed is alleviated.

Seventh, communication between the interior and the exterior of the cabinet is achieved by the support unit while the laundry treating apparatus is not in use, thereby preventing the propagation of germs and thus maintaining cleanliness and hygiene of clothes.

Eighth, user manual manipulation of the door is not necessary to achieve communication between the interior and the exterior of the cabinet, thereby improving user convenience.

Ninth, excessive opening of the door is not necessary, and therefore, interference with surrounding objects does not occur, thereby improving aesthetically pleasing appearance of products.

It should be noted that other effects may be realized from the understanding of the claims and from the practice of one skilled in the art.

What is claimed is:

1. A laundry treating apparatus comprising:

a cabinet forming an external appearance of the laundry treating apparatus, the cabinet having a laundry entrance opening for introducing laundry therethrough;

a door rotatably coupled to the cabinet for opening and closing the laundry entrance opening;

a hook provided at the door; and a door switch provided at the cabinet to stop the hook to form a separation gap between the cabinet and the door, wherein the door switch comprises:

a latch part for latching the hook when the door is closed;

a contact rod for contacting to a middle of the hook to stop the door to form the separation gap; and an actuator for moving the contact rod to move the hook.

2. The laundry treating apparatus according to claim 1, further comprising a support unit provided at the door in contact with the cabinet such that the door is separated from the cabinet by a predetermined gap.

3. The laundry treating apparatus according to claim 1, further comprising a support unit provided at the door or at the cabinet for applying elastic force to the door for opening the door when the hook is separated from the door switch.

4. The laundry treating apparatus according to claim 1, wherein the actuator is configured to move the hook from a latch position to a stop position, wherein the where latch position is where the hook is latched on the latch part and the stop position is where the hook is stopped by the contact rod to form the separation gap.

* * * * *